US009321146B1

(12) United States Patent
Rudy et al.

(10) Patent No.: US 9,321,146 B1
(45) Date of Patent: Apr. 26, 2016

(54) SYSTEMS AND METHODS FOR SHAPING LEADS OF ELECTRONIC LAPPING GUIDES TO REDUCE CALIBRATION ERROR

(71) Applicant: Western Digital (Fremont), LLC, Fremont, CA (US)

(72) Inventors: Steven C. Rudy, San Jose, CA (US); Mahendra Pakala, Fremont, CA (US); Prakash Mani, Fremont, CA (US); Eric R. McKie, Pleasanton, CA (US)

(73) Assignee: Western Digital (Fremont), LLC, Fremont, CA (US)

( * ) Notice: Subject to any disclaimer, the term of this patent is extended or adjusted under 35 U.S.C. 154(b) by 532 days.

(21) Appl. No.: 13/631,802

(22) Filed: Sep. 28, 2012

(51) Int. Cl.
*B24B 49/10* (2006.01)

(52) U.S. Cl.
CPC ..... *B24B 49/10* (2013.01)

(58) Field of Classification Search
CPC ..... G11B 5/127; H04R 31/00; B24B 49/10; B24B 49/04
USPC ..... 451/5, 8, 9, 10, 28, 1; 29/603.16, 29/603.15, 603.12
See application file for complete search history.

(56) References Cited

U.S. PATENT DOCUMENTS 4,670,732 A 6/1987 Church
5,210,667 A 5/1993 Zammit
6,027,397 A 2/2000 Church et al.
6,193,584 B1 2/2001 Rudy et al.
6,758,722 B2 7/2004 Zhu
6,760,197 B2 7/2004 Boutaghou et al.
6,786,803 B2 9/2004 Crawforth et al.
6,793,557 B2 9/2004 Bunch et al.
7,206,172 B2 4/2007 Ding et al.
7,287,316 B2 * 10/2007 Kasahara et al. ..... 29/737
7,359,152 B2 4/2008 Matono et al.
7,554,767 B1 6/2009 Hu et al.
7,564,110 B2 7/2009 Beach et al.
7,643,250 B2 1/2010 Araki et al.
7,874,063 B2 1/2011 Matono et al.
8,003,304 B2 8/2011 Nikitin et al.
8,151,441 B1 4/2012 Rudy et al.
8,165,709 B1 4/2012 Rudy
8,407,882 B2 * 4/2013 Seki et al. ..... 29/603.16

* cited by examiner

*Primary Examiner* — Robert Rose

(57) ABSTRACT

Systems and methods for shaping leads of electronic lapping guides to reduce calibration error are provided. One such system includes a device configured to generate predictable resistance for leads of an electronic lapping guide, the device including a lapping surface, and an ELG configured to provide information indicative of a degree of lapping performed on the lapping surface, the ELG including a first electrical lead, a second electrical lead spaced apart from the first electrical lead, and a resistive element between the first electrical lead and the second electrical lead, the resistive element including a right segment, a left segment, and a middle segment that abuts each of the right segment and the left segment, where the right segment is spaced apart from the left segment and the middle segment is adjacent to the lapping surface, where the first and second electrical leads are recessed from the middle segment.

35 Claims, 4 Drawing Sheets

SYSTEMS AND METHODS FOR SHAPING LEADS OF ELECTRONIC LAPPING GUIDES TO REDUCE CALIBRATION ERROR

FIELD

The present invention relates to electronic lapping guides, and more specifically to systems and methods for shaping leads of electronic lapping guides to reduce calibration error.

BACKGROUND

Hard disk drives use magnetic media to store data and a movable slider having magnetic transducers (e.g., read/write heads) positioned over the magnetic media to selectively read data from and write data to the magnetic media. Electronic lapping guides (ELGs) are used for precisely controlling a degree of lapping applied to an air bearing surface (ABS) of the sliders for achieving a particular stripe height, or distance from the ABS, for the magnetic transducers located on the sliders. U.S. Pat. No. 8,165,709 to Rudy and U.S. Pat. No. 8,151,441 to Rudy et al., the entire content of each document is hereby incorporated by reference, provide a comprehensive description of ELGs used in manufacturing sliders for hard drives. As described in both of these references, ELGs typically include two leads that sandwich a resistive element.

During fabrication processes for the ELGs described in these references, and other references in the field, it has been observed that variations in the position and size of the leads can make resistance calculations for the ELG inaccurate (e.g., due to variations in the effective ELG track width). As a result of these inaccuracies in the calculated ELG resistance, calibration errors can occur such that the control of the precise dimensions of the magnetic transducer components associated with the measured ELG resistance can become inaccurate as well. Accordingly, an ELG structure that provides predictable resistance for the ELG despite potential process variation is needed.

SUMMARY

Aspects of the invention relate to systems and methods for shaping leads of electronic lapping guides to reduce calibration error. In one embodiment, the invention relates to a device configured to generate predictable resistance for leads of an electronic lapping guide, the device including a lapping surface, and an electronic lapping guide (ELG) configured to provide information indicative of a degree of lapping performed on the lapping surface, the ELG including a first electrical lead, a second electrical lead spaced apart from the first electrical lead, and a resistive element coupled between the first electrical lead and the second electrical lead, the resistive element including a preselected shape including a right segment, a left segment, and a middle segment that abuts a bottom portion of each of the right segment and the left segment, where the right segment is spaced apart from the left segment and the middle segment is disposed adjacent to the lapping surface, where the first electrical lead and the second electrical lead are positioned further from the lapping surface than the middle segment of the resistive element.

In another embodiment, the invention relates to a method for generating predictable resistance for leads of an electronic lapping guide, the method including providing a device including a lapping surface, and an electronic lapping guide (ELG) configured to provide information indicative of a degree of lapping performed on the lapping surface, the ELG including a first electrical lead, a second electrical lead spaced apart from the first electrical lead, and a resistive element coupled between the first electrical lead and the second electrical lead, the resistive element including a preselected shape including a right segment, a left segment, and a middle segment that abuts a bottom portion of each of the right segment and the left segment, where the right segment is spaced apart from the left segment and the middle segment is disposed adjacent to the lapping surface, where the first electrical lead and the second electrical lead are positioned further from the lapping surface than the middle segment of the resistive element, lapping the lapping surface of the device, measuring a resistance of the ELG during the lapping of the lapping surface of the device, and controlling a degree of the lapping of the lapping surface of the device based on the measured resistance of the ELG and a calculated resistance of the ELG.

DETAILED DESCRIPTION

Figure 1:
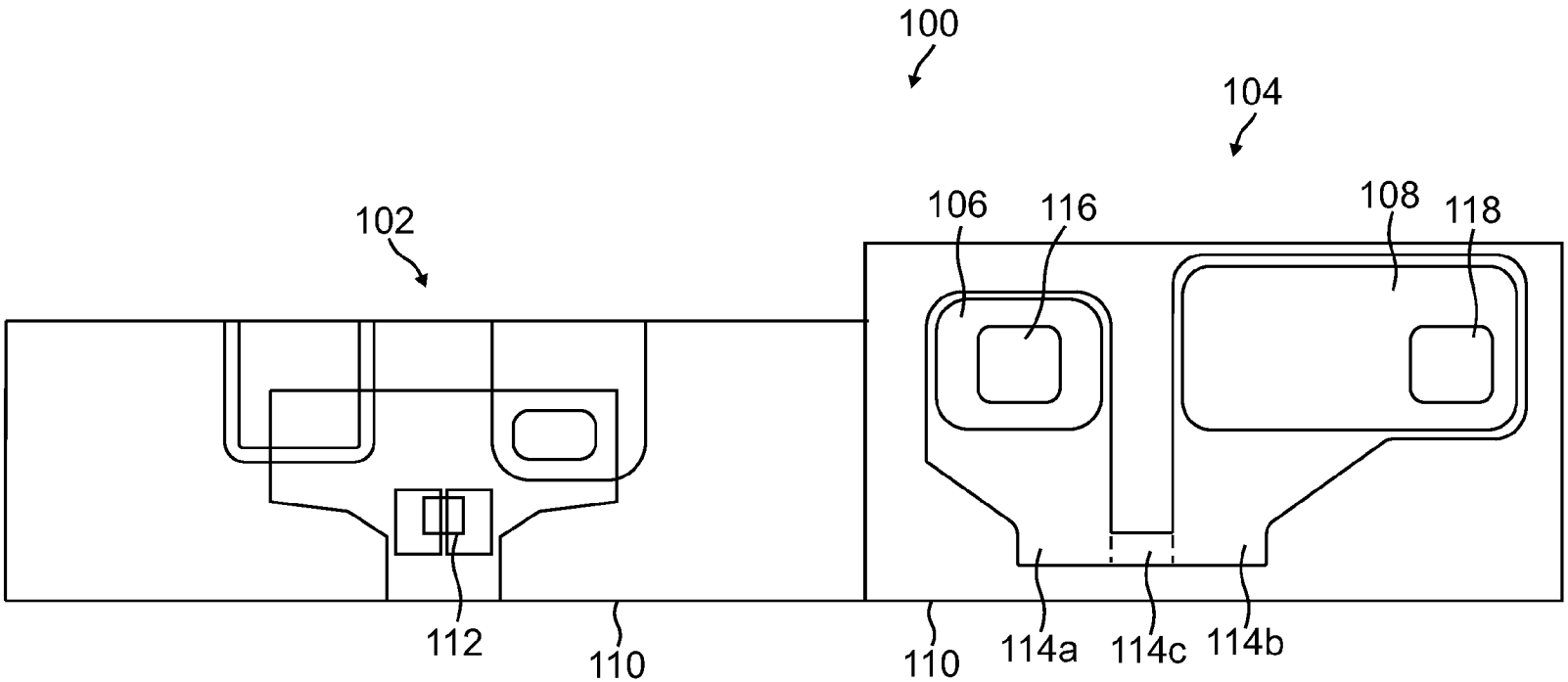
FIG. 1 is a top cross sectional view of a portion of a slider including a magnetic reader adjacent to an electronic lapping guide (ELG) having electrical leads recessed from a middle segment of a resistive element in accordance with one embodiment of the invention.

Referring now to the drawings, embodiments of electronic lapping guides (ELGs) having electrical leads recessed from a middle segment of a resistive element that provide predictable calculated ELG resistance and methods for controlling lapping processes that use the calculated ELG resistance are illustrated. The ELGs are configured to provide information indicative of a degree of lapping performed on the associated lapping surface and are typically located adjacent to a device to be lapped such as a magnetic transducer (e.g., reader or writer) located on a slider. The ELGs have a first electrical lead and a second electrical lead and a resistive element coupled between them. The resistive element has a right segment, a left segment, and a middle segment that abuts a bottom portion of each of the left and right segments, where the right segment is spaced apart from the left segment and the middle segment is adjacent to the lapping surface. The first and second electrical leads are recessed from the middle segment of the resistive element.

The resistive element typically has a resistance that is much greater than that of the electrical leads. So while recessing the low-resistance electrical leads forces current through an additional area of the high-resistance resistive element that it otherwise would not traverse (e.g., in conventional ELGs with electrical leads that extend to the lapping surface), and thereby increases the overall ELG resistance, the calculated ELG resistance becomes more predictable. This is despite potential process variations that skew the position and size of the electrical leads. As a result, calibration errors reducing the precision of the device formation associated with the ELG can be minimized or reduced.

FIG. 1 is a top cross sectional view of a portion of a slider 100 including a magnetic reader 102 adjacent to an electronic lapping guide (ELG) 104 having electrical leads (106, 108) recessed from a middle segment 114*c* of a resistive element (114*a*, 114*b*, 114*c*) in accordance with one embodiment of the invention. The magnetic reader 102 (e.g., current perpendicular to plane or CPP mode reader) includes a read sensor 112 near an air bearing surface (ABS) 110. The ELG 104 is configured to control a stripe height, or distance from the ABS 110, which is an important characteristic of the read sensor 112 by facilitating control of the degree of lapping applied at the ABS during a lapping process. More specifically, the preselected structure of the ELG 104 provides a calculated target resistance which is compared to a measured resistance of the ELG 104 during the lapping process.

The ELG 104 includes a first electrical lead 106 spaced apart from a second electrical lead 108. The ELG 104 further includes a resistive element composed of a left resistive segment 114*a*, a right resistive segment 114*b*, and a middle segment 114*c* positioned between the left resistive segment 114*a* and the right resistive segment 114*b*. The middle segment 114*c* is also positioned adjacent to the ABS 110, which is also the lapping surface. The ELG 104 further includes a first via 116 electrically coupled to the first electrical lead 106 and a second via 118 electrically coupled to the second electrical lead 108. The first electrical lead 106 is also electrically coupled to the left resistive segment 114*a*, and the second electrical lead 108 is electrically coupled to the right resistive segment 114*b*. The middle segment 114*c* is electrically coupled to the left resistive segment 114*a* and the right resistive segment 114*b*. In several embodiments, the resistive element (114*a*, 114*b*, 114*c*) is positioned on a first layer and the first electrical lead 106 and second electrical lead 108 is positioned on a second layer which is directly on top of the first layer.

In operation, a test current can be applied to the first via 116 and thereby passes through each of the first electrical lead 106, the left resistive segment 114*a*, the middle segment 114*c*, the right resistive segment 114*b*, the second electrical lead 108, and then the second via 118. Alternatively, the current can take the opposite path through these components. The measured current and applied voltage can then be used to generate a measured resistance of the ELG 104.

Figure 2:
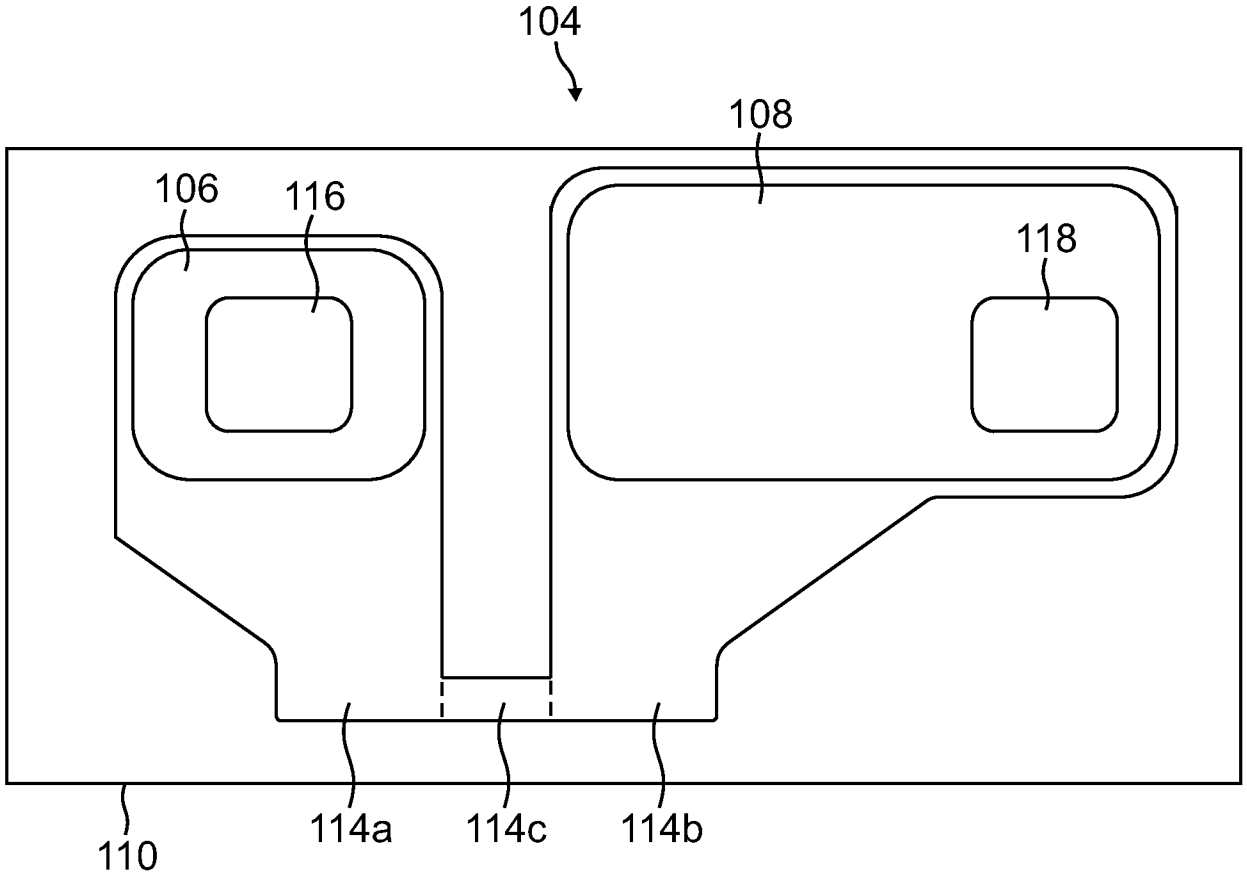
FIG. 2 is a top cross sectional view of the ELG of FIG. 2 having the electrical leads recessed from the middle segment of the resistive element in accordance with one embodiment of the invention.

FIG. 2 is a top cross sectional view of the ELG 104 of FIG. 2 having the electrical leads (106, 108) recessed from the middle segment 114*c* of the resistive element (114*a*, 114*b*, 114*c*) in accordance with one embodiment of the invention. Referring now to both FIGS. 1 and 2, the middle segment 114*c* of the resistive element provides the dominant factor in the overall ELG resistance as it presents the smallest area of the resistive element for the test current to traverse in the ELG structure. The thickness or height of the middle segment 114*c* is referred to as the stripe height of the ELG and will decrease during the lapping process to a preselected target stripe height. The width of the middle segment 114*c* which is measured in the direction of the ABS 110 is referred to as track width of the ELG. In conventional ELGs, where the electrical leads extend to the lapping surface and are not recessed from the middle segment, process variations in the width of the electrical leads can have relatively significant effects on the dimensions of the middle segment, particularly on the track width. As a result of these effects on the middle segment dimensions, the expected or calculated resistance of the ELG will no longer accurately correspond to the ELG structure fabricated and errors in reader stripe height can result.

By recessing the electrical leads 106 and 108 to areas of the resistive element that are much wider and further from the middle segment 114*c*, the effects of the process variations on ELG fabrication, and particularly on the middle segment 114*c* of the ELG, can be minimized. Also, while more area of the resistive element is traversed by the applied test current, leading to increased overall ELG resistance, the resistance of the portions of the left and right resistive segments (114*a*, 114*b*) between the first and second electrical leads (106, 108) and the middle segment 114*c* is stable and is a predictable multiple of the resistive element sheet resistance (e.g., can be calculated or characterized with relative certainty). The predictable leads resistance can be achieved by forming the electrical leads with a preselected shape spaced apart from the middle segment such that the current density across the full width of the electrical leads (106, 108) is substantially uniform rather than having the applied test current concentrated in a small region of the electrical leads nearest the middle segment of the resistive element, as might be found in conventional ELG electrical leads that extend to the ABS.

As such, the first electrical lead 106 has a preselected shape (e.g., rounded rectangular shape) that is selected to minimize a variation in the resistance of a portion of the left segment 114*a* of the resistive element between the first electrical lead 106 and the middle segment 114*c* of the resistive element during fabrication of the resistive element. The minimization of resistance variation can be accomplished by recessing the first electrical lead 106 from the ABS 110 and by spacing apart the first electrical lead 106 from the middle segment 114*c* by a preselected distance that exceeds an expected degree of process variation in the formation of the first electrical lead 106. Similarly, the second electrical lead 108 has a preselected shape (e.g., rounded rectangular shape that is somewhat larger than the shape of the first electrical lead 106) that is selected to minimize a variation in the resistance of a portion of the right segment 114*b* of the resistive element between the second electrical lead 108 and the middle segment 114*c* of the resistive element during fabrication of the resistive element. The minimization of resistance variation can be accomplished by recessing the second electrical lead 108 from the ABS 110 and by spacing apart the second electrical lead 108 from the middle segment 114*c* by a preselected distance that exceeds an expected degree of process variation in the formation of the second electrical lead 108.

As a result of recessing the first electrical lead 106 from the ABS 110 and of spacing apart the first electrical lead 106 from the middle segment 114*c* by the preselected distance, the resistance of the portion of the left segment 114*a* between the first electrical lead 106 and the middle segment 114*c* is equal to a predictable multiple of a sheet resistance of the resistive element, and is also substantially constant with the stripe height of the middle segment 114*c* of the resistive element. Similarly, as a result of recessing the second electrical lead 108 from the ABS 110 and of spacing apart the second electrical lead 108 from the middle segment 114*c* by the preselected distance, the resistance of the portion of the right segment 114*b* between the second electrical lead 108 and the middle segment 114*c* is equal to a predictable multiple of a sheet resistance of the resistive element, and is also substantially constant with the stripe height of the middle segment 114*c* of the resistive element.

In the embodiment of FIG. 1, the resistive element (114*a*, 114*b*, 114*c*) has a substantially U-shaped body where the middle segment 114*c* is substantially perpendicular to the left segment 114*a* and the right segment 114*b*. In other embodiments, the resistive element (114*a*, 114*b*, 114*c*) can have other suitable shapes. In one such embodiment, the resistive element has a bucket shape where the angle between the middle segment 114*c* and the left segment 114*a* is less than or greater than 90 degrees (e.g., not perpendicular), and similarly the angle between the middle segment 114*c* and the right segment 114*b* is less than or greater than 90 degrees (e.g., not perpendicular).

In several embodiments, the first electrical lead 106 is positioned on an internal layer of the slider 100 and the first via 116 electrically connects the first electrical lead 106 to a first pad on an outer surface of the slider 100. Similarly, in several embodiments, the second electrical lead 108 is positioned on an internal layer of the slider 100 and the second via 118 electrically connects the second electrical lead 108 to a second pad on an outer surface of the slider 100. In some embodiments, the first electrical lead 106 and the second electrical lead 108 are implemented with relatively low resistance conductive materials such as Ta, Au, Ru, Cu, Al, Pt and/or other suitable materials. In some embodiments, the resistive element is implemented with conductive materials (e.g., having a resistance somewhat higher than that of the electrical leads) such as Cr, Ru, Ta, Au and/or other suitable materials. In a number of embodiments, the resistive element and electrical leads are formed of resistive films (e.g., such that these components have a planar body shape) using one or more of these materials. In several embodiments, the resistive element and electrical leads are formed of the resistive films on different layers of a multilayer substrate (e.g., slider). In several embodiments, the first and second vias (116, 118) are made of suitable materials known in the art.

In several embodiments, the first electrical lead 106 is coupled to an upper portion of the left segment 114*a*, and the second electrical lead 108 is coupled to an upper portion of the right segment 114*b*. As can be seen in FIGS. 1 and 2, the distance from the first electrical lead 106 to the lapping surface 110 is substantially greater than the distance of the middle segment 114*c* to the lapping surface 110, and the distance from the second electrical lead 108 to the lapping surface 110 is substantially greater than the distance from the middle segment 114*c* to the lapping surface 110.

In several embodiments, the length of either the first electrical lead 106 or the second electrical lead 108 is greater than a tolerance of the fabrication process for the first and second electrical leads. In several embodiments, the distance from the first electrical lead 106 to the lapping surface 110 is greater than a tolerance of a fabrication process for the first and second electrical leads, and similarly, the distance from the second electrical lead 108 to the lapping surface 110 is greater than a tolerance of the fabrication process for the first and second electrical leads.

In a number of embodiments, the resistance of the ELG can be determined by the following formula:

$$R_{ELG} = R_L + \frac{TW_E \cdot R_{SE}}{SH_E} + K \cdot R_{SE}$$

where $R_L$ is a resistance of both the first electrical lead and the second electrical lead, $TW_E$ is a track width of the middle segment, $SH_E$ is a stripe height of the middle segment, $R_{SE}$ is a sheet resistance of the resistive element, and K is a preselected constant determined based on a shape and a size of each of the first electrical lead, the left segment of the resistive element, the second electrical lead, and the right segment of the resistive element.

$R_L$ may also include the resistance one or more low resistance components that are external to the ELG structure and created by subsequent processes. In several embodiments, however, $R_L$ can be assumed to be negligible because it is a relatively minuscule amount and fairly difficult or impossible to calculate theoretically. As a result of assuming $R_L$ to be negligible, the value of K may be modified slightly from the pure theoretical value found in the formula. In several embodiments, K is a function of the current distribution in the portion of the left segment 114*a* between the first electrical lead 106 and the middle segment 114*c* and in the portion of the right segment 114*b* between the second electrical lead 108 and the middle segment 114*c*. In such case, the sensitivity to dimensional variation is greatly reduced as compared to conventional ELGs due to the increased width over which conduction takes place. More specifically, the current can be well distributed across the edge of the first electrical lead and second electrical lead closest to the lapped surface with an electrical lead width (or length of a non-linear edge) that is greater than the expected dimensional error in the leads.

Figure 3:
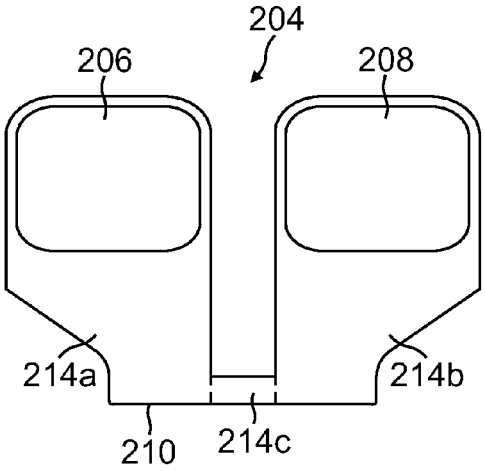
FIG. 3 is a top cross sectional view of an ELG having electrical leads recessed from the middle segment of the resistive element with a second preselected shape in accordance with one embodiment of the invention.

FIG. 3 is a top cross sectional view of an ELG 204 having electrical leads (206, 208) recessed from the middle segment 214*c* of the resistive element (214*a*, 214*b*, 214*c*) with a second preselected shape in accordance with one embodiment of the invention. The ELG 204 includes the first electrical lead 206 and the second electrical lead 208 that have rounded rectangular shapes that are about equal in size as distinguished from the unequally shaped leads of FIGS. 1 and 2. The resistive element again includes a left resistive segment 214*a* and a right resistive segment 214*b* separated by a middle resistive segment 214*c*. The ELG structure can function substantially as described above for the embodiments of FIGS. 1 and 2. In several embodiments, the ELG 204 further includes first and second vias (not shown) and other structures or circuitry commonly used in the manufacture of ELGs.

Figure 4:
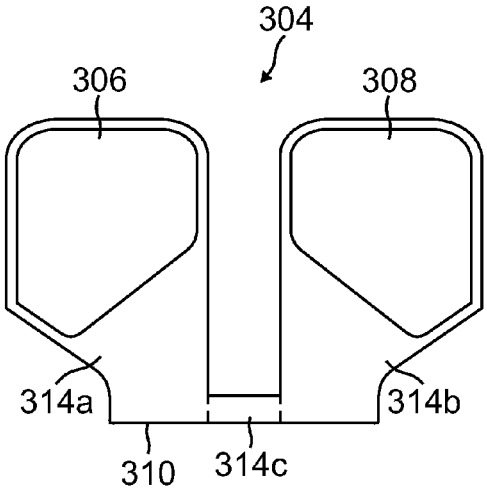
FIG. 4 is a top cross sectional view of an ELG having electrical leads recessed from the middle segment of the resistive element with a third preselected shape in accordance with one embodiment of the invention.

FIG. 4 is a top cross sectional view of an ELG 304 having electrical leads (306, 308) recessed from the middle segment 314*c* with a third preselected shape in accordance with one embodiment of the invention. The ELG 304 includes a first electrical lead 306 and a second electrical lead 308 that have rounded right trapezoid shapes where the non-perpendicular side is closest to a middle segment 314*c* of the resistive element. In addition, the first electrical lead 306 and the second electrical lead 308 are about equal in size as distinguished from the unequally shaped leads of FIGS. 1 and 2. The resistive element again includes a left resistive segment 314*a* and a right resistive segment 314*b* separated by the middle resistive segment 314*c*. The ELG structure can function substantially as described above for the embodiments of FIGS. 1 and 2. In several embodiments, the ELG 304 further includes first and second vias (not shown) and/or other structures or circuitry commonly used in the manufacture of ELGs.

Figure 5:
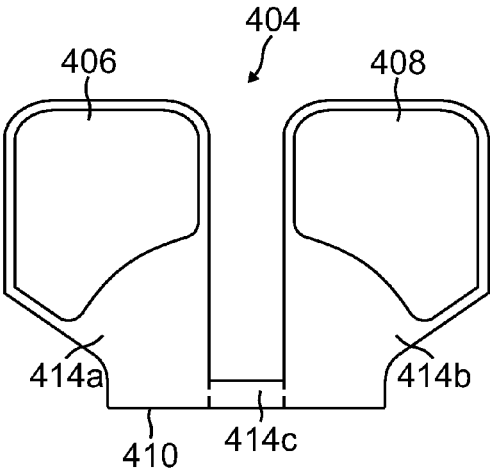
FIG. 5 is a top cross sectional view of an ELG having electrical leads recessed from the middle segment of the resistive element with a fourth preselected shape in accordance with one embodiment of the invention.

FIG. 5 is a top cross sectional view of an ELG 404 having electrical leads (406, 408) recessed from the middle segment 414*c* with a fourth preselected shape in accordance with one embodiment of the invention. Similar to the ELG embodiment of FIG. 4, the ELG 404 includes a first electrical lead 406 and a second electrical lead 408 that have rounded right trapezoid shapes except that the non-perpendicular side is instead shaped with an arc-shaped recess where the arc-shaped recess is positioned closest to a middle segment 414*c* of the resistive element. In addition, the first electrical lead 406 and the second electrical lead 408 are about equal in size as distinguished from the unequally shaped leads of FIGS. 1 and 2. The resistive element again includes a left resistive segment 414*a* and a right resistive segment 414*b* separated by the middle resistive segment 414*c*. The ELG structure can function substantially as described above for the embodiments of FIGS. 1 and 2. In several embodiments, the ELG 404 further includes first and second vias (not shown) and/or other structures or circuitry commonly used in the manufacture of ELGs.

FIGS. 1-5 illustrate particular preselected shapes for implementing recessed electrical leads of an ELG. In other embodiments, other suitable shapes for the recessed electrical leads can also be used.

Figure 6:
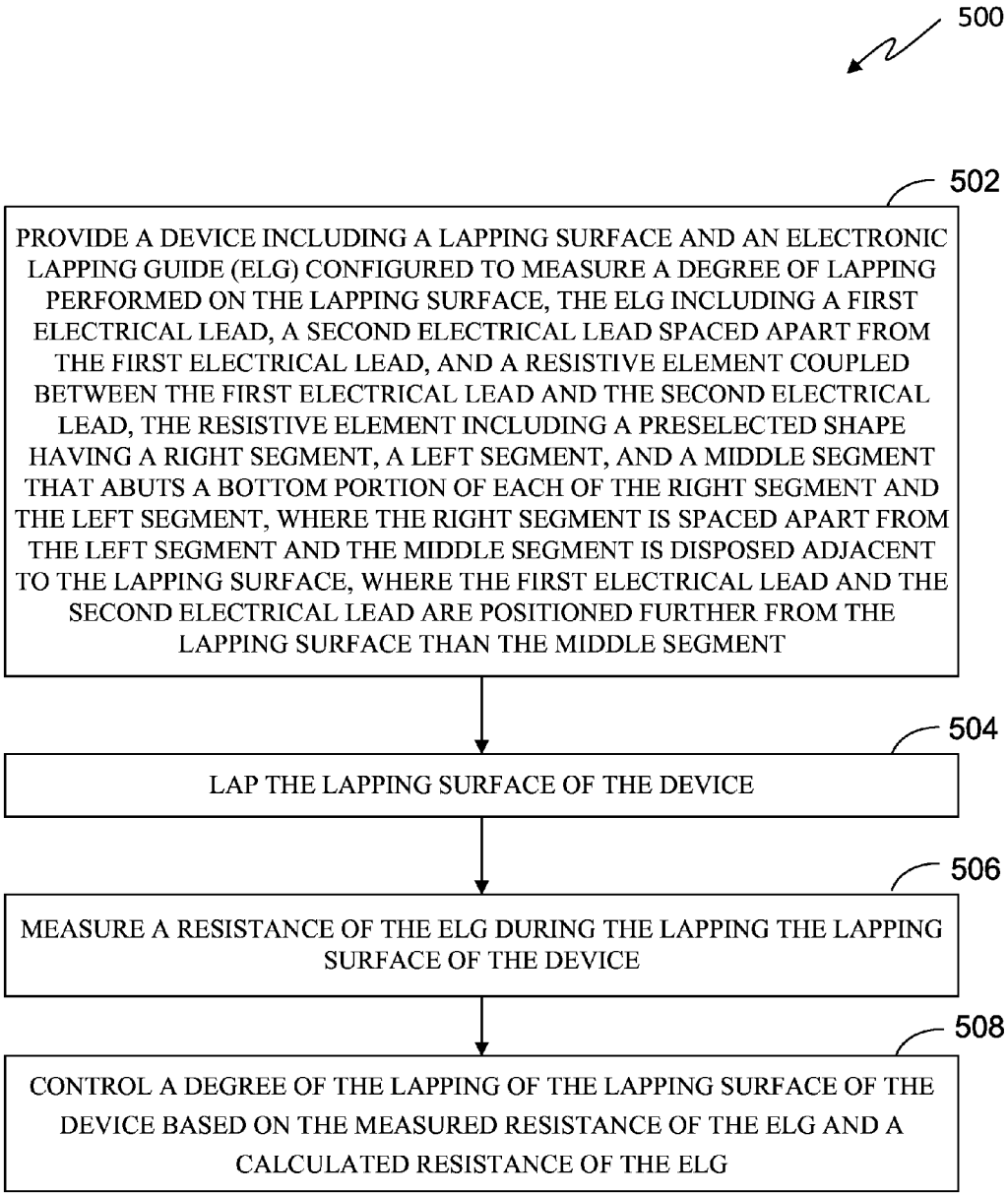
FIG. 6 is a flow chart of a process for controlling a lapping process using an ELG having electrical leads recessed from the middle segment of the resistive element in accordance with one embodiment of the invention.

FIG. 6 is a flow chart of a process 500 for controlling a lapping process using an ELG having electrical leads recessed from a middle segment of a resistive element in accordance with one embodiment of the invention. In particular embodiments, the process 500 can be used to control any of the ELGs described above. The process first provides (502) a device including a lapping surface, an ELG configured to provide information indicative of a degree of lapping performed on the lapping surface, the ELG including a first electrical lead, a second electrical lead spaced apart from the first electrical lead, and a resistive element coupled between the first electrical lead and the second electrical lead, the resistive element including a preselected shape having a right segment, a left segment, and a middle segment that abuts a bottom portion of each of the right segment and the left segment, where the right segment is spaced apart from the left segment and the middle segment is disposed adjacent to the lapping surface, where the first electrical lead and the second electrical lead are positioned further from the lapping surface than the middle segment of the resistive element. In several embodiments, the device is a slider for a hard disk drive.

The process then laps (504) the lapping surface of the device. The process measures (506) the resistance of the ELG during the lapping of the lapping surface of the device. The process then controls (508) a degree of the lapping of the lapping surface of the device based on the measured resistance of the ELG and a calculated resistance of the ELG.

In several embodiments, the device is a slider which includes a magnetic head having an initial stripe height to be reduced by the lapping process to a desired stripe height. In such case, the portion (e.g., middle segment) of the resistive element is configured to be lapped during the lapping process along with the magnetic head.

In one embodiment, the process can perform the sequence of actions in a different order. In another embodiment, the process can skip one or more of the actions. In other embodiments, one or more of the actions are performed simultaneously. In some embodiments, additional actions can be performed.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A device configured to generate predictable resistance for leads of an electronic lapping guide, the device comprising:

a lapping surface; and an electronic lapping guide (ELG) configured to provide information indicative of a degree of lapping performed on the lapping surface, the ELG comprising:

a first electrical lead;

a second electrical lead spaced apart from the first electrical lead; and a resistive element coupled between the first electrical lead and the second electrical lead, the resistive element comprising a preselected shape including a right segment, a left segment, and a middle segment that abuts a bottom portion of each of the right segment and the left segment, wherein the right segment is spaced apart from the left segment and the middle segment is disposed adjacent to the lapping surface, wherein a resistance of the first lead and a resistance of the second lead is less than a resistance of the resistive element;

wherein the first electrical lead and the second electrical lead are positioned further from the lapping surface than the middle segment of the resistive element.

2. The device of claim 1:

wherein the first electrical lead and the second electrical lead are positioned further from the lapping surface than a top edge the middle segment of the resistive element; and wherein the first electrical lead is coupled to an upper portion of the left segment and the second electrical lead is coupled to an upper portion of the right segment.

3. The device of claim 1, wherein the preselected shape is selected from the group consisting of a U-shape where the middle segment is substantially perpendicular to either of the right segment or the left segment and a bucket-shape where an angle between the middle segment and either of the right segment or the left segment is greater than or less than 90 degrees.

4. The device of claim 1:

wherein the first electrical lead comprises a preselected shape configured to minimize a variation in a resistance of a portion of the left segment of the resistive element between the first electrical lead and the middle segment of the resistive element during fabrication of the resistive element; and wherein the second electrical lead comprises a preselected shape configured to minimize a variation in a resistance of a portion of the right segment of the resistive element between the second electrical lead and the middle segment of the resistive element during fabrication of the resistive element.

5. The device of claim 4:

wherein the first electrical lead comprises a shape selected from the group consisting of a rectangular shape and a trapezoidal shape; and wherein the second electrical lead comprises a shape selected from the group consisting of a rectangular shape and a trapezoidal shape.

6. The device of claim 4:

wherein the resistance of the portion of the left segment is equal to a predictable multiple of a sheet resistance of the resistive element; and wherein the resistance of the portion of the right segment is equal to a predictable multiple of the sheet resistance of the resistive element.

7. The device of claim 4:

wherein the resistance of the portion of the left segment is substantially constant with a stripe height of the resistive element; and wherein the resistance of the portion of the right segment is substantially constant with a stripe height of the resistive element.

8. The device of claim 1:

wherein the first electrical lead is disposed on an internal layer of the device;

wherein the ELG comprises a first pad on an outer surface of the device and a first via coupling the first pad to the first electrical lead;

wherein the second electrical lead is disposed on the internal layer of the device; and wherein the ELG comprises a second pad on the outer surface of the device and a second via coupling the second pad to the second electrical lead.

9. The device of claim 1:

wherein the first electrical lead and the second electrical lead each comprise a material selected from the group consisting of Ta, Au, Ru, Cu, Al, Pt and combinations thereof; and wherein the resistive element comprises a material selected from the group consisting of Cr, Ru, Ta, Au and combinations thereof.

10. The device of claim 1:

wherein the first electrical lead is coupled to an upper portion of the left segment and the second electrical lead is coupled to an upper portion of the right segment;

wherein a distance of the first electrical lead to the lapping surface is substantially greater than a distance of the middle segment to the lapping surface; and wherein a distance of the second electrical lead to the lapping surface is substantially greater than a distance of the middle segment to the lapping surface.

11. The device of claim 10, wherein the preselected shape is selected from the group consisting of a V-shape where the middle segment is substantially perpendicular to either of the right segment or the left segment and a bucket-shape where an angle between the middle segment and either of the right segment or the left segment is greater than or less than 90 degrees.

12. The device of claim 1:

wherein each of the first electrical lead and the second electrical lead comprises a rectangular shape having a width substantially parallel to the lapping surface and a height; and wherein the width of either the first electrical lead or the second electrical lead is greater than a tolerance of a fabrication process for the first electrical lead and the second electrical lead.

13. The device of claim 1:

wherein a distance of the first electrical lead to the lapping surface is greater than a tolerance of a fabrication process for the first electrical lead and the second electrical lead; and wherein a distance of the second electrical lead to the lapping surface is greater than a tolerance of a fabrication process for the first electrical lead and the second electrical lead.

14. The device of claim 1:

wherein a resistance of the ELG (RELG) is determined according to the formula:

$$R_{ELG} = R_L + \frac{TW_E \cdot R_{SE}}{SH_E} + K \cdot R_{SE}$$

where $R_L$ is a resistance of both the first electrical lead and the second electrical lead, $TW_E$ is a track width of the middle segment, $SH_E$ is a stripe height of the middle segment, $R_{SE}$ is a sheet resistance of the resistive element, and K is a preselected constant determined based on a shape and a size of each of the first electrical lead, the left segment of the resistive element, the second electrical lead, and the right segment of the resistive element.

15. The device of claim 1, wherein the device further comprises a magnetic head proximate the ELG and is a component selected from the group consisting of a magnetic reader and a magnetic writer.

16. The device of claim 15, wherein the magnetic head has an initial stripe height to be reduced by a lapping process to a desired stripe height, and wherein the middle segment of the resistive element is configured to be lapped during the lapping process.

17. A method for generating predictable resistance for leads of an electronic lapping guide, the method comprising:

providing a device comprising:

a lapping surface; and an electronic lapping guide (ELG) configured to provide information indicative of a degree of lapping performed on the lapping surface, the ELG comprising:

a first electrical lead;

a second electrical lead spaced apart from the first electrical lead; and a resistive element coupled between the first electrical lead and the second electrical lead, the resistive element comprising a preselected shape including a right segment, a left segment, and a middle segment that abuts a bottom portion of each of the right segment and the left segment, wherein the right segment is spaced apart from the left segment and the middle segment is disposed adjacent to the lapping surface and wherein a resistance of the first and second leads is less than a resistance of the resistive element;

wherein the first electrical lead and the second electrical lead are positioned further from the lapping surface than the middle segment of the resistive element;

lapping the lapping surface of the device;

measuring a resistance of the ELG during the lapping of the lapping surface of the device; and controlling a degree of the lapping of the lapping surface of the device based on the measured resistance of the ELG and a calculated resistance of the ELG.

18. The method of claim 17:

wherein the first electrical lead and the second electrical lead are positioned further from the lapping surface than a top edge the middle segment of the resistive element; and wherein the first electrical lead is coupled to an upper portion of the left segment and the second electrical lead is coupled to an upper portion of the right segment.

19. The method of claim 17, wherein the preselected shape is selected from the group consisting of a U-shape where the middle segment is substantially perpendicular to either of the right segment or the left segment and a bucket-shape where an angle between the middle segment and either of the right segment or the left segment is greater than or less than 90 degrees.

20. The method of claim 17:

wherein the first electrical lead comprises a preselected shape configured to minimize a variation in a resistance of a portion of the left segment of the resistive element between the first electrical lead and the middle segment of the resistive element during fabrication of the resistive element; and wherein the second electrical lead comprises a preselected shape configured to minimize a variation in a resistance of a portion of the right segment of the resistive element between the second electrical lead and the middle segment of the resistive element during fabrication of the resistive element.

21. The method of claim 20:

wherein the first electrical lead comprises a shape selected from the group consisting of a rectangular shape and a trapezoidal shape; and wherein the second electrical lead comprises a shape selected from the group consisting of a rectangular shape and a trapezoidal shape.

22. The method of claim 20:

wherein the resistance of the portion of the left segment is equal to a predictable multiple of a sheet resistance of the resistive element; and wherein the resistance of the portion of the right segment is equal to a predictable multiple of the sheet resistance of the resistive element.

23. The method of claim 20:

wherein the resistance of the portion of the left segment is substantially constant with a stripe height of the resistive element; and wherein the resistance of the portion of the right segment is substantially constant with a stripe height of the resistive element.

24. The method of claim 17:

wherein the first electrical lead is disposed on an internal layer of the device;

wherein the ELG comprises a first pad on an outer surface of the device and a first via coupling the first pad to the first electrical lead;

wherein the second electrical lead is disposed on the internal layer of the device; and wherein the ELG comprises a second pad on the outer surface of the device and a second via coupling the second pad to the second electrical lead.

25. The method of claim 17:

wherein the first electrical lead and the second electrical lead each comprise a material selected from the group consisting of Ta, Au, Ru, Cu, Al, Pt and combinations thereof; and wherein the resistive element comprises a material selected from the group consisting of Cr, Ru, Ta, Au and combinations thereof.

26. The method of claim 17:

wherein the first electrical lead is coupled to an upper portion of the left segment and the second electrical lead is coupled to an upper portion of the right segment;

wherein a distance of the first electrical lead to the lapping surface is substantially greater than a distance of the middle segment to the lapping surface; and wherein a distance of the second electrical lead to the lapping surface is substantially greater than a distance of the middle segment to the lapping surface.

27. The method of claim 26, wherein the preselected shape is selected from the group consisting of a U-shape where the middle segment is substantially perpendicular to either of the right segment or the left segment and a bucket-shape where an angle between the middle segment and either of the right segment or the left segment is greater than or less than 90 degrees.

28. The method of claim 17:

wherein each of the first electrical lead and the second electrical lead comprises a rectangular shape having a width substantially parallel to the lapping surface and a height; and wherein the width of either the first electrical lead or the second electrical lead is greater than a tolerance of a fabrication process for the first electrical lead and the second electrical lead.

29. The method of claim 17:

wherein a distance of the first electrical lead to the lapping surface is greater than a tolerance of a fabrication process for the first electrical lead and the second electrical lead; and wherein a distance of the second electrical lead to the lapping surface is greater than a tolerance of a fabrication process for the first electrical lead and the second electrical lead.

30. The method of claim 17, wherein a resistance of the ELG (RELG) is determined according to the formula:

$$R_{ELG} = R_L + \frac{TW_E \cdot R_{SE}}{SH_E} + K \cdot R_{SE}$$

where $R_L$ is a resistance of both the first electrical lead and the second electrical lead, $TW_E$ is a track width of the middle segment, $SH_E$ is a stripe height of the middle segment, $R_{SE}$ is a sheet resistance of the resistive element, and K is a preselected constant determined based on a shape and a size of each of the first electrical lead, the left segment of the resistive element, the second electrical lead, and the right segment of the resistive element.

31. The method of claim 17, wherein the device further comprises a magnetic head proximate the ELG and is a component selected from the group consisting of a magnetic reader and a magnetic writer.

32. The method of claim 17, wherein the magnetic head has an initial stripe height to be reduced by a lapping process to a desired stripe height, and wherein the middle segment of the resistive element is configured to be lapped during the lapping process.

33. The method of claim 17, wherein the calculated resistance is based on:

a resistance of a portion of the left segment of the resistive element between the first electrical lead and the middle segment of the resistive element;

a resistance of a portion of the right segment of the resistive element between the second electrical lead and the middle segment of the resistive element; and a resistance of the middle segment of the resistive element.

34. A device configured to generate predictable resistance for leads of an electronic lapping guide, the device comprising:

a lapping surface; and an electronic lapping guide (ELG) configured to provide information indicative of a degree of lapping performed on the lapping surface, the ELG comprising:

a first electrical lead on a first layer;

a second electrical lead spaced apart from the first electrical lead on the first layer; and a resistive element coupled between the first electrical lead and the second electrical lead on a second layer spaced apart from the first layer, the resistive element comprising a preselected shape including a right segment, a left segment, and a middle segment that abuts a bottom portion of each of the right segment and the left segment, wherein the right segment is spaced apart from the left segment and the middle segment is disposed adjacent to the lapping surface;

wherein the first electrical lead and the second electrical lead are positioned further from the lapping surface than the middle segment of the resistive element.

35. The device of claim 34, wherein a resistance of the first lead is less than a resistance of the resistive element and a resistance of the second lead is less than the resistance of the resistive element.

* * * * *